US005266436A

United States Patent [19]

Aoto et al.

[11] Patent Number: 5,266,436

[45] Date of Patent: Nov. 30, 1993

[54] DEVELOPER-BEARING MEMBER AND IMAGE FORMATION METHOD USING THE SAME

[75] Inventors: Jun Aoto; Yasuo Hirano, both of Numazu, Japan

[73] Assignee: Ricoh Company, Ltd., Tokyo, Japan

[21] Appl. No.: 825,547

[22] Filed: Jan. 24, 1992

[30] Foreign Application Priority Data

Jan. 25, 1991 [JP] Japan ..... 3-25779
Apr. 11, 1991 [JP] Japan ..... 3-106855

[51] Int. Cl.[5] ..... G03G 15/08

[52] U.S. Cl. ..... 430/120; 430/903; 355/259

[58] Field of Search ..... 430/120, 122, 903; 355/259

[56] References Cited

U.S. PATENT DOCUMENTS 4,444,864 4/1984 Takahashi ..... 430/120

5,096,798 3/1992 Kanbe et al. ..... 430/120

*Primary Examiner*—John Goodrow

*Attorney, Agent, or Firm*—Cooper & Dunham

[57] ABSTRACT

A developer-bearing member with the surface thereof being composed of minute dielectric portions and minute electroconductive portions which are mixedly distributed, the dielectric portions containing an amino coupling agent, is used in an image formation method including the steps of forming numerous micro closed electric fields near the surface of the developer-bearing member by causing the developer-bearing member to selectively hold electric charges on the surface thereof, supplying a non-magnetic one-component type developer containing a toner to the surface of the developer-bearing member to hold the toner on the surface of the developer-bearing member by the micro closed electric fields, and developing a latent electrostatic image formed on a latent-electrostatic-image bearing member to a visible toner image by the toner.

25 Claims, 2 Drawing Sheets

DEVELOPER-BEARING MEMBER AND IMAGE FORMATION METHOD USING THE SAME

BACKGROUND OF THE INVENTION

1. Field of the Invention

The present invention relates to a developer-bearing member with a surface comprising minute dielectric portions and minute electroconductive portions which are mixedly distributed, the dielectric portions comprising an amino coupling agent. The present invention also relates to an image formation method of developing a latent electrostatic image to a visible image using the above developer-bearing member.

2. Discussion of Background

In conventional image formation apparatus, such as electrophotographic copying machines, printers and facsimile apparatus, in which latent electrostatic images are formed on a latent-electrostatic-image bearing member and developed to visible images by a developer, dry type development units using a powder-like developer are widely used.

As such powder-like developers, a two-component type developer comprising a toner and a carrier, and a one-component type developer comprising a toner without containing a carrier, are conventionally known.

A two-component type development method using the above two-component type developer is capable of yielding relatively stable, good recorded images, but has the shortcomings that the deterioration of the carrier is easily caused, and the mixing ratio of the toner and the carrier tends to change while in use, so that the maintenance of an apparatus using this method is complicated. Furthermore, the apparatus using the two-component type development method is relatively oversized.

From the above viewpoint, the primary focus of attention is on a one-component type development method using the one-component type developer, which does not have the above-mentioned shortcomings as in the two-component type development method.

There are two types of one-component type developers. One is of a type which consists of a toner, while the other is of a type which consists of a mixture of a toner and an auxiliary agent.

Furthermore, there are two types of toners. One is a magnetic toner which contains magnetic particles, and the other is a non-magnetic toner which does not contain magnetic particles.

Generally, the above-mentioned magnetic particles are not transparent. Therefore, it is extremely difficult to obtain clear color images including full-color images and multi-colored images by use of a magnetic toner. Therefore, it is preferable to employ a one-component type development method using a non-magnetic toner when colored images are to be obtained.

In a development unit using the one-component type development method, a one-component type developer is held on a developer-bearing member and transported into a development zone where a latent-electrostatic-image-bearing member and the developer-bearing member face each other, and the latent electrostatic images formed on the latent-electrostatic-image-bearing member are developed to visible images by the one-component type developer. In such a development unit, however, it is required that a large amount of a sufficiently charged toner be transported into the above-mentioned development zone and used for the development of the latent-electrostatic images in order to obtain visible images with high quality and a predetermined image density.

When a one-component type developer consisting of a magnetic toner is employed, the above requirement can be met relatively easily because the one-component type developer can be held on a developer-bearing member by us of the magnetic force of an inner magnet built therein. However, when a non-magnetic one-component type developer is employed, it is difficult to meet the above requirement because the developer cannot be magnetically held on the developer-bearing member.

Various proposals have been made as countermeasures for the above-mentioned problem. For example, in Japanese Laid-Open Patent Application 61-42672, there is proposed a method of developing latent electrostatic images into visible images by the following steps: bringing a reversely rotating sponge roller made of electroconductive polyurethane, into pressure contact with a development roller having a float electrode and a medium resistivity of $10^9$ to $10^{11}$ Ω·cm, serving as a developer-bearing member; mechanically transporting a toner into a gap between the sponge roller and the development roller, and tribo-electrically charging the toner; holding the charged toner on the development roller; forming a toner layer on the development roller, with regulating the thickness thereof with a blade; and bringing the toner layer into contact with latent electrostatic images formed on a photoconductor.

In this method, however, the intensity of an electric field formed near the surface of the dielectric portions of the development roller cannot be sufficiently increased, so that it is difficult to hold a large amount of the toner on the surface of the development roller. Accordingly, the amount of the developer that can be transported into the development zone decreases in the course of the development process. As a result, visible images with high density cannot be obtained.

In addition to the above, there is known a development unit having a structure by which an electric field is applied between a development roller and a developer supply member in such a direction that a non-magnetic toner is electrostatically moved toward the development roller. This structure, however, is not capable of depositing a sufficient amount of the toner on the development roller for obtaining images with high quality and high density.

As such toner supply members, there are known an electroconductive foamed member with an electric resistivity of $10^2$ to $10^6$ Ω·cm as disclosed in Japanese Laid-Open Patent Application 60-229067, an elastic member with a skin layer as disclosed in Japanese Laid-Open Patent Application 60-229060, and a fur brush as disclosed in Japanese Laid-Open Patent Application 61-42672.

Furthermore, as such development rollers, there are proposed a metallic development roller with an uneven surface as disclosed in Japanese Laid-Open Patent Application 60-53976, a development roller covered with an insulating overcoat layer as disclosed in Japanese Laid-Open Patent Application 55-46768, a development roller with an overcoat layer having a medium electric resistivity as disclosed in Japanese Laid-Open Patent Application 58-132768, and an electrode development roller with an insulating surface and an electroconductive surface as disclosed in Japanese Laid-Open Patent Application 53-36245.

In conventional development units using a non-magnetic one-component type developer, a toner is triboelectrically charged by the friction between the toner and a toner supply member, such as a sponge roller disclosed in Japanese Laid-Open Patent Application 60-229067, an elastic roller disclosed in Japanese Laid-Open Patent Application 62-229060, and a fur brush disclosed in Japanese Laid-Open Patent Application 61-52663, the toner is electrostatically deposited on the surface of a development roller by the friction between the toner and the development roller, a toner layer is regulated by a thickness-regulating member such as a blade, whereby latent electrostatic images formed on a photoconductor are developed to visible images by the toner. As the materials for the development roller for such conventional development units, for example, insulating materials, materials with a medium electric resistivity and layered materials are employed.

In the development methods disclosed in the above references, the toner is deposited on the development roller by the triboelectric charging between the toner supply member and the development roller. However, as the above triboelectric charging is performed between the toner-deposited toner supply member and the toner-deposited development roller, sufficient charging cannot be obtained. The result is that the deposition of the toner on the development roller becomes insufficient for obtaining toner images with high image density.

The optimum deposition amount of a non-magnetic one-component type toner and a charge quantity of the toner in a development method using a non-magnetic one-component type developer will now be explained.

For black and white copying, the electric charge quantity of the toner is important and preferably in the range of 10 to 20 $\mu C/g$. When the charge quantity is less than the above range, toner deposition on the background tends to occur and the obtained images are poor in sharpness. Furthermore, it is necessary that the toner deposition on the development roller be in the range of 0.1 to 0.3 $mg/cm^2$, and that the toner deposition on an image transfer sheet be in the range of 0.4 to 0.5 $mg/cm^2$. This toner deposition on the image transfer sheet is attained by setting the rotation speed of the development roller at 3 to 4 times the speed of a photoconductor. When the rotation speed of the development roller is set in the above range, there is a problem that a developed solid toner image has a higher density in a rear end portion of the toner image than in the other portion. This phenomenon is referred to as "toner rear end shifting". In order to solve this problem, the rotation speed of the development roller has to be set as close as possible to that of the photoconductor. In order to obtain high quality images by this setting of the rotation speed of the development roller, the deposition amount of the toner on the development roller must be increased and the number of revolution must be decreased.

On the other hand, in the case of color toners, with respect to the color characteristics thereof, the colored degree is smaller than that of black toners. Furthermore, it is necessary that the toner be deposited on the development roller in an amount of 0.8 to 1.2 $mg/cm^2$ in order to prevent "toner rear end shifting". It is required that the charge quantity of the toner be in the range of 5 to 20 $\mu C/g$, preferably in the range of 10 to 15 $\mu C/g$ in order to obtain stable toner images. It is also required that a so-called filming phenomenon, in which the toner is deposited on the surface of the development roller, be prevented so that the deposition amount of the toner and the charge quantity can be stably obtained for a long period of time.

In order to solve these conventional problems, the inventors of the present invention previously proposed an image formation method in which a one-component type developer comprising a non-magnetic toner, when necessary with addition of auxiliary agents thereto, is supplied to the surface of a development roller which is rotatably driven to transport the developer into a development zone where a latent-electrostatic-image-bearing member is directed to the above-mentioned developer-bearing member, so that the latent electrostatic images formed on the latent-electrostatic-image-bearing member are developed to visible images, characterized in that numerous micro closed electric fields are formed near the surface of the developer-bearing member by selectively causing the surface of the developer-bearing member to support electric charges, the charged toner is attracted by these closed electric fields to deposit the developer on the surface of the developer-bearing member, thereby developing the latent electrostatic images to visible toner images.

This method has many advantages over the conventional methods, including the advantage that the intensity of the electric fields can be significantly increased in comparison with the case where the conventional methods are employed, since a number of micro closed electric fields are formed near the surface of the developer-bearing member, and therefore a large amount of sufficiently charged non-magnetic toner can be deposited on the developer-bearing member and transported into the development zone.

However the above image formation method using the developer-bearing member with numerous micro fields near the surface thereof has the shortcoming that the triboelectric charging properties are significantly changed when a variety of materials are used in the dielectric portions in order to obtain the other properties which are necessary for the developer-bearing member, such as toner release characteristics, low frictional properties, and abrasion resistance. Therefore, it is very difficult to meet the requirements for the deposition amount and the charge quantity of the toner, and the other properties of the toner.

SUMMARY OF THE INVENTION

It is therefore an object of the present invention to provide a developer-bearing member which can maintain the stable deposition amount of toner and the charge quantity thereof, by controlling the triboelectric charging properties thereof in such a manner that varieties of dielectric materials can be employed in the surface portion of the developer-bearing member.

Another object of the present invention is to provide an image formation method of obtaining images with high density and high quality.

The first object of the present invention is attained by a developer-bearing member with the surface thereof comprising minute dielectric portions and minute electroconductive portions which are mixedly distributed, the dielectric portions comprising an amino coupling agent, which is used in an image formation method comprising the steps of forming numerous micro closed electric fields near the surface of the developer-bearing member by causing the developer-bearing member to selectively hold electric charges on the surface thereof, supplying a non-magnetic one-component type developer comprising a toner to the surface of the developer-bearing member to hold the toner on the surface of the developer-bearing member by the micro closed electric fields, and developing a latent electrostatic image formed on a latent-electrostatic-image bearing member to a visible toner image by the toner.

The second object is attained by an image formation method of developing a latent electrostatic image formed on a latent-electrostatic-image bearing member with a non-magnetic one-component type developer comprising a toner, comprising the steps of (1) forming numerous micro closed electric fields near the surface of the above-mentioned developer-bearing member by causing the developer-bearing member to selectively hold electric charges on the surface thereof, (2) supplying the developer to the surface of the developer-bearing member to hold the toner on the surface of the developer-bearing member by the micro closed electric fields, and (c) developing the latent electrostatic image to a visible toner image by the toner, the surface of the developer-bearing member comprising minute dielectric portions and minute electroconductive portions which are mixedly distributed, the dielectric portions comprising an amino coupling agent.

DETAILED DESCRIPTION OF THE PREFERRED EMBODIMENTS

Figure 1:
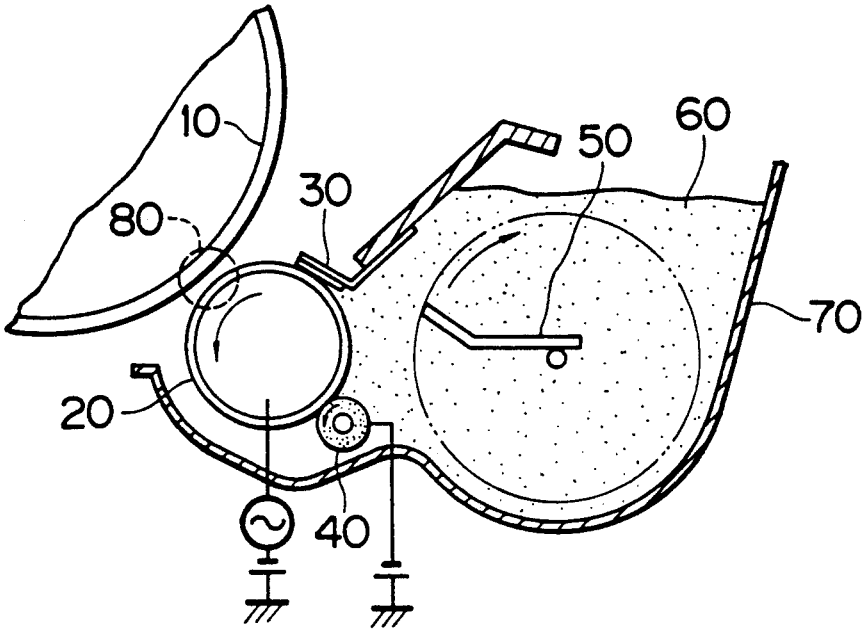
FIG. 1 is a schematic cross-sectional view of a development apparatus including a developer-bearing member on which a number of micro fields are formed, which is useful to carry out the present invention.

The surface portion of the developer-bearing member according to the present invention comprises minute dielectric portions and minute electroconductive portions which are mixedly distributed, and the dielectric portions comprise an amino coupling agent.

As the amino coupling agent contained in the dielectric portions of the developer-bearing member, aminosilane coupling agent and aminotitanate-containing coupling agent can be used.

Specific examples of the amonosilane coupling agent are as follows:

(1) $H_2NCH_2CH_2CH_2Si(OCH_3)_3$
(2) $H_2NHC_2CH_2CH_2Si(OC_2H_5)_3$
(3) $H_2NCH_2CH_2CH_2Si(CH_3)(OCH_3)_2$
(4) $H_2NCH_2CH_2NHCH_2CH_2CH_2Si(CH_3)(OCH_3)_2$
(5) $H_2NCONHCH_2CH_2CH_2Si(OC_2H_5)_3$
(6) $H_2NCH_2CH_2NHCH_2CH_2CH_2Si(OCH_3)_3$
(7) $H_2NCH_2CH_2NHCH_2CH_2NHCH_2CH_2CH_2Si(OCH_3)_3$
(8) $H_5C_2OCOCH_2CH_2NHCH_2CH_2CH_2Si(OCH_3)_3$
(9) $H_5C_2OCOCH_2CH_2NHCH_2CH_2NHCH_2CH_2Si(OCH_3)_3$
(10) $H_5C_2OCOCH_2NHCH_2CH_2NHCH_2CH_2NHCH_2CH_2NHCH_2CH_2CH_2Si(OCH_3)_3$
(11) $H_3COCOCH_2CH_2NHCH_2CH_2NHCH_2CH_2Si(OCH_3)_3$
(12) $(H_5C_2)_2NCH_2CH_2CH_2Si(OCH_3)_3$
(13) $H_2N—Ph—Si(OCH_3)_3$
(14) $Ph—NHCH_2CH_2CH_2Si(OCH_3)_3$
(15) $H_2NCH_2CH_2NHCH_2—Ph—CH_2CH_2Si(OCH_3)_3$
(16) $(H_9C_4)_2NCH_2CH_2CH_2Si(OCH_3)_3$

A specific example of the aminotitanate-containing coupling agent is $(H_3C)_2CH—O—Ti[—OC_2H_4—NH—C_2H_4—NH_2]_3$.

It is preferable that the amino coupling agent contained in the dielectric portions is in an amount of 0.1 to 10 wt.% of the entire weight of the dielectric portions.

Any dielectric materials can be employed in the dielectric portions. However, it is preferable to employ a dielectric material having a resistivity of $10^{12}$ Ω·cm or more, more preferably $10^{14}$ Ω·cm or more.

Specific examples of the dielectric material are the following organic polymers: vinyl resins such as polyvinyl chloride, polyvinyl butyral, polyvinyl alcohol, polyvinylidene chloride, polyvinyl acetate, and polyvinylformal; polystyrene resins such as polystyrene, styrene-acrylonitrile copolymer, and acrylonitrile-butadiene-styrene copolymer; polyethylene resins such as polyethylene, and ethylene—vinyl acetate copolymer; acrylic resins such as polymethylmethacrylate, and polymethylmethacrylate-styrene copolymer; other resins such as polyacetal, polyamide, cellulose, polycarbonate, phenoxy resin, polyester, fluorine plastics, polyurethane, phenolic resin, urea resin, melamine resin, epoxy resin, unsaturated polyester resin, and silicone resin; and rubber materials such as natural rubber, isoprene rubber, butadiene rubber, styrene-butadiene rubber, butyl rubber, ethylene-propylene rubber, chloroprene rubber, chlorinated polyethylene rubber, epichlorohydrin rubber, nitrile rubber, acrylic rubber, urethane rubber, polysulfide rubber, silicone rubber, fluororubber, and silicone-modified ethylene-propylene rubber.

On the other hand, an electroconductive material having a resistivity of less than $10^{12}$ Ω·cm, preferably $10^{8}$ Ω·cm or less can be used in the electroconductive portions of the developer-bearing member according to the present invention. Examples of the above electroconductive material are metals such as Al, SUS, Fe and Ni.

In addition to the above, a composition comprising a ceramic or an organic polymer, and an electroconductivity-imparting agent can be employed as the electroconductive material. In this case, the same organic polymers as employed in the dielectric portions of the developer-bearing member can also be used in the electroconductive portions.

Specific examples of the above electroconductivity-imparting agent are metal powders such as Ni and Cu; carbon blacks such as furnace black, lamp black, thermal black, acetylene black, and channel black, electroconductive oxides such as tin oxide, zinc oxide, molybdenum oxide, antimony oxide, and potassium titanate; electrolessly plated materials such as electrolessly plated titanium oxide and electrolessly plated mica; and inorganic fillers and surface active agents such as graphite, metallic fibers and carbon fibers. In addition to the above, an organic ion conductor such as a metal-ion-coordinated polymer matrix of polyethylene oxide or polysiloxane.

As numerous micro closed electric fields are formed near the surface of the developer-bearing member of the present invention, the strength of the electric fields thereof is remarkable larger than the conventional developer-bearing members. Moreover, since the dielectric portions of the developer-bearing member of the present invention comprise an amino coupling agent, the charge properties of the dielectric portions are improved and the sufficient deposition amount of toner and the charge quantity thereof can be maintained. As a result, a large amount on the developer-bearing member and transported to the development zone repeatedly for a long period of time.

In the image formation method of the present invention, the dielectric portions of the developer-bearing member are positively charged because the amino coupling agent is contained therein. Therefore, sufficiently large micro closed electric fields can be formed on the developer-bearing member for development of the latent electrostatic images. As the dielectric portions on the surface of the developer-bearing member are positively charged, it is preferable to employ a toner which is chargeable to a negative polarity.

With reference to the accompanying drawings, the above-mentioned image formation method will now be explained.

FIG. 1 schematically shows a representative development apparatus including a developer-bearing member, which is useful for the image formation method of the present invention. In the figure, a toner 60 which is held in a toner tank 70 is forced to move toward a toner supply member 40 such as a sponge roller or a fur brush by a stirring blade 50 serving as a toner-supply auxiliary member, so that the toner 60 is supplied to the toner supply member 40. When a development operation has been finished, a developer-bearing member 20 of the present invention such as a development roller is rotated in the direction of the arrow, for example, at a rotation speed of 400 rpm, and reaches a portion where the developer-bearing member 20 comes into contact with the toner supply member 40. The toner supply member 40 is rotated in the direction opposite to the rotary direction of the developer-bearing member 20, for example, at a rotation speed of 300 rpm, and applies electric charges to both the developer-bearing member 20 and the toner 60, so that the toner 60 is deposited on the developer-bearing member 20. The developer-bearing member 20 is further rotated and the electric charge of the toner deposited on the developer-bearing member 20 is stabilized as a thickness of a toner layer is regulated by a toner-layer-thickness regulation member 30 such as an elastic blade. The toner layer on the developer-bearing member 20 then reaches a development zone 80, where the latent electrostatic images are developed to visible toner images by either a contact development or a non-contact development. When necessary, a D.C. voltage, A.C. voltage, a D.C.-superimposed A.C. voltage or a bias voltage, for instance, in the form of pulses, may be applied to the developer-bearing member 20 and the toner supply member 40 in order to optimize the quality of the developed images.

Figure 2:
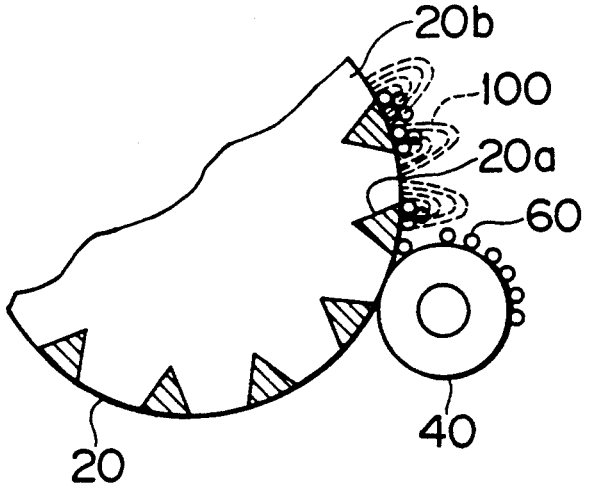
FIG. 2 is a schematic cross-sectional view of the developer-bearing member shown in FIG. 1, on which micro closed fields are formed.

The mechanism of the toner deposition onto the developer-bearing member 20 of an electrode type will now be explained. An example of the developer-bearing member 20 is shown in FIG. 2. As shown in the figure, the surface of the developer-bearing member is composed of a number of minute dielectric portions 20*a* and minute electroconductive portions 20*b* which are mixedly distributed. When the shape of each portion is circular, each of the portions has a diameter in the range of 10 to 500 μm, and these portions are arranged at random or in a certain order. It is preferable that the total area ratio of the electroconductive portions 20*b* be in the range of 20 to 60% of the entire surface of the developer-bearing member 20.

The deposition of the toner 60 on the developer-bearing member 20 takes place as follows: After the development process, the developer-bearing member 20 is rotated in the direction of the arrow and comes into contact with the toner supply member 40. The toner which has not be used for development and remains on the developer-bearing member 20 is mechanically and/or electrically scraped off by the toner triboelectrically charged. By this triboelectric charging, the electric charge of the developer-bearing member 20 and that of the toner 60 on the developer-bearing member 20 which occured during the previous development process are made constant and initialized for the next development. The toner carried by the toner supply member 40 is tribo-electrically charged and electrostatically deposited on the dielectric portions 20*a* of the developer-bearing member 20. At this moment, the polarity of the toner is opposite to the polarity of the charge of a latent-electrostatic-image-bearing member 10, and the polarity of the dielectric portions 20*a* of the developer-bearing member 20 is the same as the charge of the latent-electrostatic-image-bearing member 10.

The electric fields formed on the developer-bearing member 20 are micro closed fields 100 with a large electric field inclination as illustrated in FIG. 2, so that the toner can be deposited thereon in multiple layers. Because of the micro closed fields 100, the toner deposited on the developer-bearing member 20 is firmly attracted to the surface of the developer-bearing member 20 and is therefore hardly separated therefrom.

The thickness of the toner layer formed on the developer-bearing member 20 is regulated by the toner-layer-thickness-regulating member 30, and the toner layer reaches the development zone 80. As the electric field between the developer-bearing member 20 and the latent-electrostatic-image-bearing member 10 such as a photoconductor in the development zone 80 has a large electrode effects, the toner deposited on the developer-bearing member 20 is easily attracted to the latent-electrostatic-image-bearing member 10, so that the latent electrostatic images are developed into visible images.

Figure 3A:
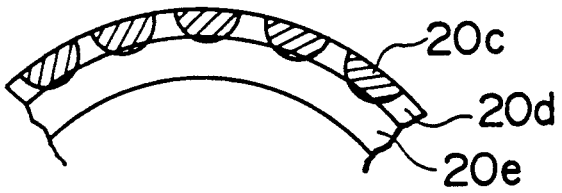
FIG. 3(*a*) and 3(*b*) are the schematic cross-sectional views of surface structures of the developer-bearing member of the present invention.
Figure 3B:
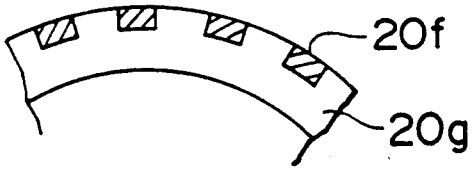

A V-groove type roller shown in FIG. 2 is a representative example of the developer-bearing member on which surface numerous minute dielectric portions and minute electroconductive portions are mixedly distributed. FIG. 3(*a*) and 3(*b*) also show examples of the developer-bearing member of the present invention.

In FIG. 3 (*a*), 20*c* indicates electroconductive particles; 20*d*, a dielectric portion; and 20*e*, an electroconductive adhesive layer. In FIG. 3 (*b*), 20*f* indicates a dielectric portion; and 20*g*, an electroconductive portion.

The developer-bearing member of the present invention can be made by the conventional molding methods such as spray coating, dipping, injection molding, extrusion molding and press molding. The V-groove type roller as shown in FIG. 2 is made as follows:

(i) V-grooves are formed on a surface of a metal roller. The latticed V-grooves can be formed by knurling. The V-grooves are formed with a pitch of 0.1 to 0.5 mm, with an inclination of about 45° C. with respect to the longitudinal direction of the metal roller as illustrated in FIG. 4(*a*).

(ii) The previously mentioned dielectric material containing an amino coupling agent is coated on the V-grooves-formed surface of the metal roller by spray coating or dipping so that the grooves are completely filled with the dielectric material. The thus coated dielectric material is cured or dried under predetermined conditions such as temperature and time as illustrated in FIG. 4(*b*).

Figure 4A:
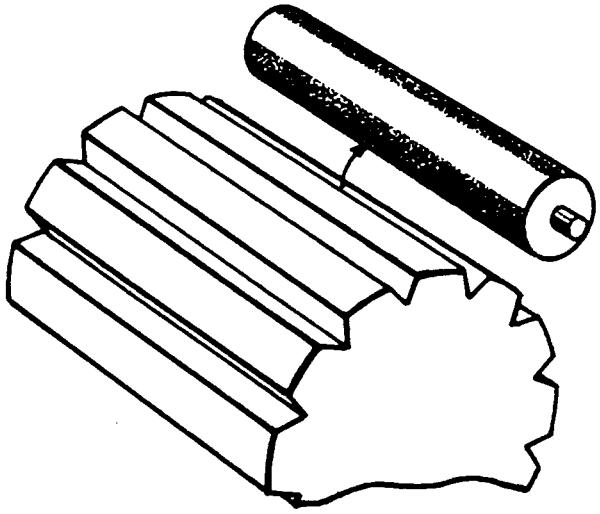
FIG. 4(*a*) to 4(*c*) are the schematic cross-sectional views of the developer-bearing member for use in a development apparatus of the type shown in FIG. 1, in particular showing the surface conditions of the developer-bearing member in the course of the production thereof.
Figure 4B:
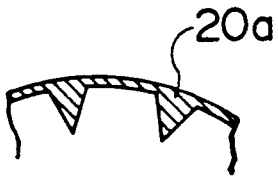
Figure 4C:
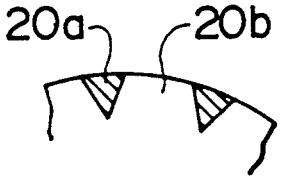

(iii) The surface of the roller is cut or polished in such a manner that the minute electroconductive portions 20*b* and the minute dielectric portions 20*a* are mixedly distributed, with a total area ratio of the electroconductive portions 20*b* to the entire surface being in the range of 20 to 60% as illustrated in FIG. 4(*c*).

The features of this invention will become apparent in the course of the following description of exemplary embodiments which are given for illustration of the invention and are not intended to be limiting thereof.

EXAMPLE 1

[Preparation of Dielectric Material]

The following components were mixed to prepare the dielectric material:

| | parts by weight |
|---|---|
| Silicone resin (Trademark "SR2411", made by Toray Dow-Corning Silicone Co., Ltd.) | 100 |
| γ-(2-aminoethyl)aminopropyl-trimethoxysilane (Trademark "SH6020", made by Toray Dow-Corning Silicone Co., Ltd.) | 5 |
| Xylene | 200 |
| n-butanol | 200 |

[Formation of V-grooves]

The V-grooves were formed on the surface of an aluminum roller having a thickness of 25 mm by knurling, with a pitch of 0.2 mm and an inclination of about 45° with respect to the longitudinal direction of the roller.

[Coating of Dielectric Material]

The previously mentioned dielectric material was coated on the V-grooves-formed surface of the aluminum roller by spray coating, and then cured at 100° C. for one hour so that the grooves are completely filled with the dielectric material.

Then the surface of the roller was polished in such a manner that the minute electroconductive portions of aluminum and the minute dielectric portions are mixedly distributed, with a total area ratio of the electroconductive portions to the entire surface being 35%, whereby a developer-bearing member of the present invention was obtained.

EXAMPLE 2

The procedure for preparing the developer-bearing member in Example 1 was repeated except that the formulation of the dielectric material in Example 1 was changed to the following formulation, whereby a developer-bearing member of the present invention was obtained:

| | parts by weight |
|---|---|
| Silicone resin (Trademark "KR255", made by Shin-Etsu Chemical Co., Ltd.) | 100 |
| Isopropyltri(N-aminoethyl-aminoethyl)titanate | 5 |
| Toluene | 300 |

EXAMPLE 3

The procedure for preparing the developer-bearing member in Example 1 was repeated except that the formulation of the dielectric material in Example 1 was changed to the following formulation, whereby a developer-bearing member of the present invention was obtained:

| | parts by weight |
|---|---|
| Fluorine copolymer resin (Trademark "Lumifron 601C", made by Asahi Glass Co., Ltd.) | 100 |
| N-β-(N-vinylbenzylaminoethyl)-γ-aminopropyl trimethoxysilane hydrochloride (Trademark "SZ6032", made by Toray Dow-Corning Silicone Co., Ltd.) | 5 |
| Methy ethyl ketone | 500 |

EXAMPLE 4

The procedure for preparing the developer-bearing member in Example 1 was repeated except that the formulation of the dielectric material in Example 1 was changed to the following formulation, whereby a developer-bearing member of the present invention was obtained:

| | parts by weight |
|---|---|
| Urethane resin (Trademark "C-230U", made by Hirono Chemical Co., Ltd.) | 100 |
| Curing agent (Trademark "PU-614", made by Hirono Chemical Co., Ltd.) | 30 |
| γ-anilinopropyltrimethoxy-silane (Trademark "SZ6083", made by Toray Dow-Corning Silicone Co., Ltd.) | 5 |
| Methyl ethyl ketone | 200 |
| Solvent A | 50 |

The formulation of the above solvent A was as follows:

[Solvent A]

| | parts by weight |
|---|---|
| Toluene | 39.0 |
| Ethyl acetate | 17.5 |
| Butyl acetate | 17.5 |
| Ethyl cellosolve acetate | 17.5 |
| Methyl isobutyl ketone | 3.9 |
| Xylene | 2.6 |
| Cyclohexane | 2.0 |

COMPARATIVE EXAMPLE 1

The procedure for preparing the developer-bearing member in Example 1 was repeated except that γ-(2-aminoethyl)aminopropyltrimethoxysilane contained in the dielectric material in Example 1 was not used, whereby a comparative developer-bearing member was obtained.

COMPARATIVE EXAMPLE 2

The procedure for preparing the developer-bearing member in Example 2 was repeated except that isopropyltri-(N-aminoethyl-aminoethyl)titanate contained in the dielectric material in Example 2 was replaced by γ-glycidoxypropyltrimethoxysilane (Trademark "KBM403", made by Shin-Etsu Chemical Co., Ltd.), whereby a comparative developer-bearing member was obtained.

COMPARATIVE EXAMPLE 3

The procedure for preparing the developer-bearing member in Example 3 was repeated except that N-β-(N-vinylbenzylaminoethyl)-γ-aminopropyltrimethoxysilane hydrochloride contained in the dielectric material in Example 3 was not used, whereby a comparative developer-bearing member was obtained.

COMPARATIVE EXAMPLE 4

The procedure for preparing the developer-bearing member in Example 4 was repeated except that γ-anilinopropyltrimethoxysilane contained in the dielectric material in Example 4 was not used, whereby a comparative developer-bearing member was obtained.

Each of the thus obtained developer-bearing members was incorporated in the development unit as shown in FIG. 1. The employed toner was a negatively chargeable toner. In the development unit, the toner-layer-thickness regulating blade was made of an urethane rubber and the toner supply member was made of an electroconductive urethane sponge. The charge quantity of the toner was measured by the blow-off method and the amount of the toner deposited on the developer-bearing member was measured by the adhesive-tape transfer method. The results are shown in Table 1.

TABLE 1

| Example No. | Charge Quantity of Toner (μC/g) | Deposition Amount of Toner (mg/cm²) |
|---|---|---|
| Example 1 | −15.3 | 1.20 |
| Example 2 | −12.2 | 1.05 |
| Example 3 | −13.1 | 1.15 |
| Example 4 | −14.7 | 1.23 |
| Comp. Ex. 1 | −6.4 | 0.51 |
| Comp. Ex. 2 | −7.2 | 0.70 |
| Comp. Ex. 3 | −4.1 | 0.46 |
| Comp. Ex. 4 | −5.0 | 0.72 |

It is obvious from Table 1 that the developer-bearing member of the present invention comprising an amino coupling agent in the dielectric portions thereof can attract the satisfactory charge quantity of the negatively charged toner and the deposition amount thereof for developing the latent electrostatic images into the visible images. As a result, a large amount of the sufficiently charged non-magnetic toner can be deposited on the developer-bearing member and transported to the development zone repeatedly for a long period of time. Therefore, the image formation method using the above developer-bearing member can provide images with high density and high quality.

What is claimed is:

1. In a developer-bearing member for use in an image formation method comprising the steps of forming numerous micro closed electric fields near the surface of said developer-bearing member by causing said developer-bearing member to selectively hold electric charges on the surface thereof, supplying a non-magnetic one-component type developer comprising a toner to the surface of said developer-bearing member to hold said toner on the surface of said developer-bearing member by said micro closed electric fields, and developing a latent electrostatic image formed on a latent-electrostatic-image bearing member to a visible toner image by said toner, the improvement wherein said surface of said developer-bearing member comprises minute dielectric portions and minute electroconductive portions which are mixedly distributed, said dielectric portions comprising an amino coupling agent.

2. The developer-bearing member as claimed in claim 1, wherein said amino coupling agent is an aminosilane coupling agent.

3. The developer-bearing member as claimed in claim 1, wherein said amino coupling agent is an aminotitanate-containing coupling agent.

4. The developer-bearing member as claimed in claim 2, wherein said aminosilane coupling agent is selected from the group consisting of:

(1) $H_2NCH_2CH_2CH_2Si(OCH_3)_3$
(2) $H_2NHC_2CH_2CH_2Si(OC_2H_5)_3$
(3) $H_2NCH_2CH_2CH_2Si(CH_3)(OCH_3)_2$
(4) $H_2NCH_2CH_2NHCH_2CH_2CH_2Si(CH_3)(OCH_3)_2$
(5) $H_2NCONHCH_2CH_2CH_2Si(OC_2H_5)_3$
(6) $H_2NCH_2CH_2NHCH_2CH_2CH_2Si(OCH_3)_3$
(7) $H_2NCH_2CH_2NHCH_2CH_2NHCH_2CH_2CH_2Si(OCH_3)_3$
(8) $H_5C_2OCOCH_2CH_2NHCH_2CH_2CH_2Si(OCH_3)_3$
(9) $H_5C_2OCOCH_2CH_2NHCH_2CH_2NHCH_2CH_2Si(OCH_3)_3$
(10) $H_5C_2OCOCH_2NHCH_2CH_2NHCH_2CH_2NHCH_2CH_2NHCH_2CH_2CH_2Si\ (OCH_3)_3$
(11) $H_3COCOCH_2CH_2NHCH_2CH_2NHCH_2CH_2Si(OCH_3)_3$
(12) $(H_5C_2)_2NCH_2CH_2CH_2Si(OCH_3)_3$
(13) $H_2N—Ph—Si(OCH_3)_3$
(14) $Ph—NHCH_2CH_2CH_2Si(OCH_3)_3$
(15) $H_2NCH_2CH_2NHCH_2—Ph—CH_2CH_2Si(OCH_3)_3$
(16) $(H_9C_4)_2NCH_2CH_2CH_2Si(OCH_3)_3$

5. The developer-bearing member as claimed in claim 3, wherein said aminotitanate-containing coupling agent is $(H_3C)_2CH—O—Ti[—OC_2H_4—NH—C_2H_4—NH_2]_3$.

6. The developer-bearing member as claimed in claim 1, wherein said amino coupling agent contained in said dielectric portions is in an amount of 0.1 to 10 wt.% of the entire weight of said dielectric portions.

7. The developer-bearing member as claimed in claim 1, wherein said dielectric portions comprise a dielectric material having a resistivity of $10^{12}$ Ω·cm or more.

8. The developer-bearing member as claimed in claim 1, wherein said electroconductive portions comprise an electroconductive material having a resistivity of less than $10^{12}$ Ω·cm.

9. The developer-bearing member as claimed in claim 1, wherein a total area ratio of said electroconductive portions to the entire surface of said developer-bearing member is in the range of 20 to 60%.

10. The developer-bearing member as claimed in claim 7, wherein said dielectric material is a vinyl resin selected from the group consisting of: polyvinyl chloride, polyvinyl butyral, polyvinyl alcohol, polyvinylidene chloride, polyvinyl acetate, and polyvinylformal.

11. The developer-bearing member as claimed in claim 7, wherein said dielectric material is a polystyrene resin selected from the group consisting of: polystyrene, styrene -acrylonttrile copolymer, and acrylonitrile-butadiene-styrene copolymer.

12. The developer-bearing member as claimed in claim 7, wherein said dielectric material is a polyethylene resin selected from the group consisting of: polyethylene, and ethylene-vinyl acetate copolymer.

13. The developer-bearing member as claimed in claim 7, wherein said dielectric material is an acrylic resin selected from the group consisting of: polymethylmethacrylate, and polymethylmethacrylate-styrene copolymer.

14. The developer-bearing member as claimed in claim 7, wherein said dielectric material is a resin selected from the group consisting of: polyacetal, polyamide, cellulose, polycarbonate, phenoxy resin, polyester, fluorine plastics, polyurethane, phenolic resin, urea resin, melamine resin, epoxy resin, unsaturated polyester resin, and silicone resin.

15. The developer-bearing member as claimed in claim 7, wherein said dielectric material is a rubber material selected from the group consisting of: natural rubber, isoprene rubber, butadiene rubber, styrene - butadiene rubber, butyl rubber, ethylene - propylene rubber, chloroprene rubber, chlorinated polyethylene rubber, epichlorohydrin rubber, nitrile rubber, acrylic rubber, urethane rubber, polysulfide rubber, silicone rubber, fluororubber, and silicone-modified ethylene - propylene rubber.

16. The developer-bearing member as claimed in claim 8, wherein said electroconductive material is a metal.

17. The developer-bearing member as claimed in claim 8, wherein said electroconductive material is a composition comprising a ceramic or an organic polymer, and an electroconductivity-imparting agent.

18. The developer-bearing member as claimed in claim 17, wherein said electroconductivity-imparting agent is a metal powder.

19. The developer-bearing member as claimed in claim 17, wherein said electroconductivity-imparting agent is carbon black.

20. The developer-bearing member as claimed in claim 17, wherein said electroconductivity-imparting agent is an electroconductive oxide selected from the group consisting of: tin oxide, zinc oxide, molybdenum oxide, antimony oxide, and potassium titanate.

21. The developer-bearing member as claimed in claim 17, wherein said electroconductivity-imparting agent is an electrolessly plated material 22. The developer-bearing member as claimed in claim 17, wherein said electroconductivity-imparting agent is selected from the group consisting of graphite, metallic fibers, and carbon fibers.

23. The developer-bearing member as claimed in claim 17, wherein said electroconductivity-imparting agent is an organic ion conductor.

24. An image formation method of developing a latent electrostatic image formed on a latent-electrostatic-image bearing member with a non-magnetic one-component type developer comprising a toner, comprising the steps of:

forming numerous micro closed electric fields near the surface of a developer-bearing member by causing said developer-bearing member to selectively hold electric charges on the surface thereof;

supplying said developer to the surface of said developer-bearing member to hold said toner on the surface of said developer-bearing member by said micro closed electric fields; and developing said latent electrostatic image to a visible toner image by said toner, the surface of said developer-bearing member comprising minute dielectric portions and minute electroconductive portions which are mixedly distributed, said dielectric portions comprising an amino coupling agent.

25. The image formation method as claimed in claim 24, wherein said non-magnetic one-component type developer is a toner which is chargeable to a negative polarity.

* * * * *